US007453061B2

(12) United States Patent
Park et al.

(10) Patent No.: US 7,453,061 B2
(45) Date of Patent: Nov. 18, 2008

(54) HYPERBOLIC QUADRUPOLE MASS FILTER MADE OF PLATINUM GROUP METAL COATED QUARTZ TUBE

(75) Inventors: Chang-Joon Park, Daejeong (KR); Sae-Won Yoon, Daejeon (KR)

(73) Assignee: Korea Research Institute of Standards and Science (KR)

( * ) Notice: Subject to any disclaimer, the term of this patent is extended or adjusted under 35 U.S.C. 154(b) by 214 days.

(21) Appl. No.: 11/567,923

(22) Filed: Dec. 7, 2006

(65) Prior Publication Data

US 2007/0138389 A1 Jun. 21, 2007

(30) Foreign Application Priority Data

Dec. 19, 2005 (KR) ..... 10-2005-0125083

(51) Int. Cl.
*H01J 49/42* (2006.01)

(52) U.S. Cl. ..... 250/292

(58) Field of Classification Search ..... 250/292; 313/256; 445/49

See application file for complete search history.

(56) References Cited

U.S. PATENT DOCUMENTS

| | | | | |
|---|---|---|---|---|
| 3,328,146 | A | 6/1967 | Hanlein | |
| 4,885,500 | A | 12/1989 | Hansen et al. | |
| 5,616,919 | A | 4/1997 | Broadbent et al. | |
| 7,276,688 | B2 * | 10/2007 | Weiss | 250/288 |

FOREIGN PATENT DOCUMENTS

| | | |
|---|---|---|
| JP | 1994-096726 | 4/1994 |
| JP | 1995-326321 | 12/1995 |
| JP | 1998-021871 | 1/1998 |
| JP | 1998-172507 | 6/1998 |
| JP | 1999-025904 | 1/1999 |
| JP | 1999-086781 | 3/1999 |

* cited by examiner

*Primary Examiner*—Kiet T Nguyen
(74) *Attorney, Agent, or Firm*—Cantor Colburn LLP

(57) ABSTRACT

The present invention relates to a quadrupole mass analyzer which is a core equipment of a majority of mass analyzer, particularly to a quadrupole mass analyzer with a hyperbolic surface made of quartz which is capable of enhancing resolving power and analytical performance of a mass analyzer. The quadrupole mass analyzer according to the present invention includes four quartz tubes separated by predetermined distance to form a shape of rotation symmetry and being parallel to each other; an electric part formed with a predetermined area by a platinum membrane being divided into a prefilter electrode part and a main filter electrode part in a longitudinal direction of the quartz tube in a circumferential surface in an axial direction of the rotation symmetry of the quartz tube, a cross-section of the platinum membrane on an opposing quartz tube forming a substantial hyperbolic surface; a quartz pin being chamfered at both ends in a shape with a same radius curvature as the quartz tube and being closely fixed between the adjacent quartz tubes; and an electrically conductive connection member electrically connecting each of prefilter electrode parts and main filter parts of the opposing quartz tubes so as to apply RF and DC electric source.

6 Claims, 6 Drawing Sheets

【Fig. 1】
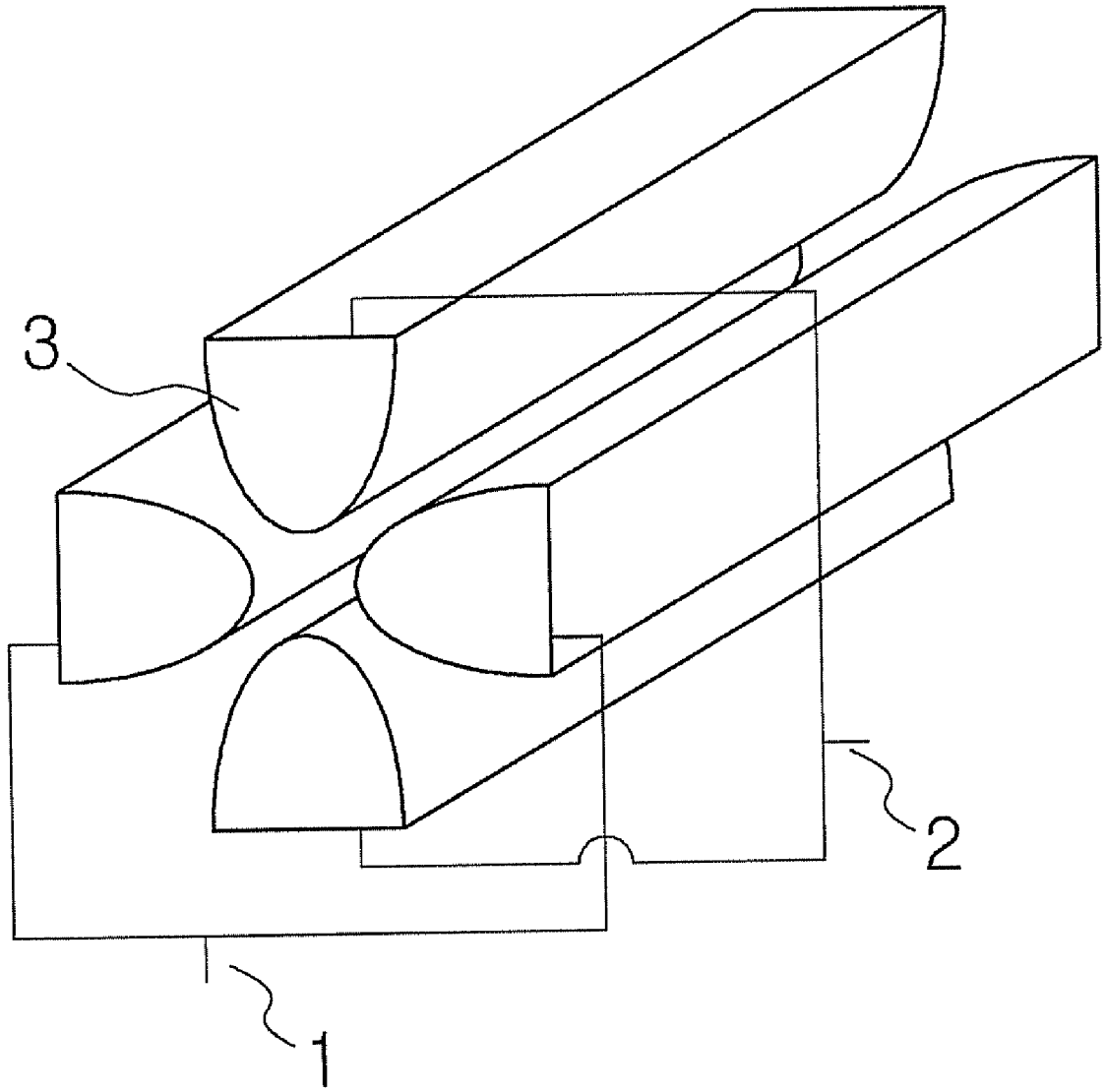

【Fig. 2】
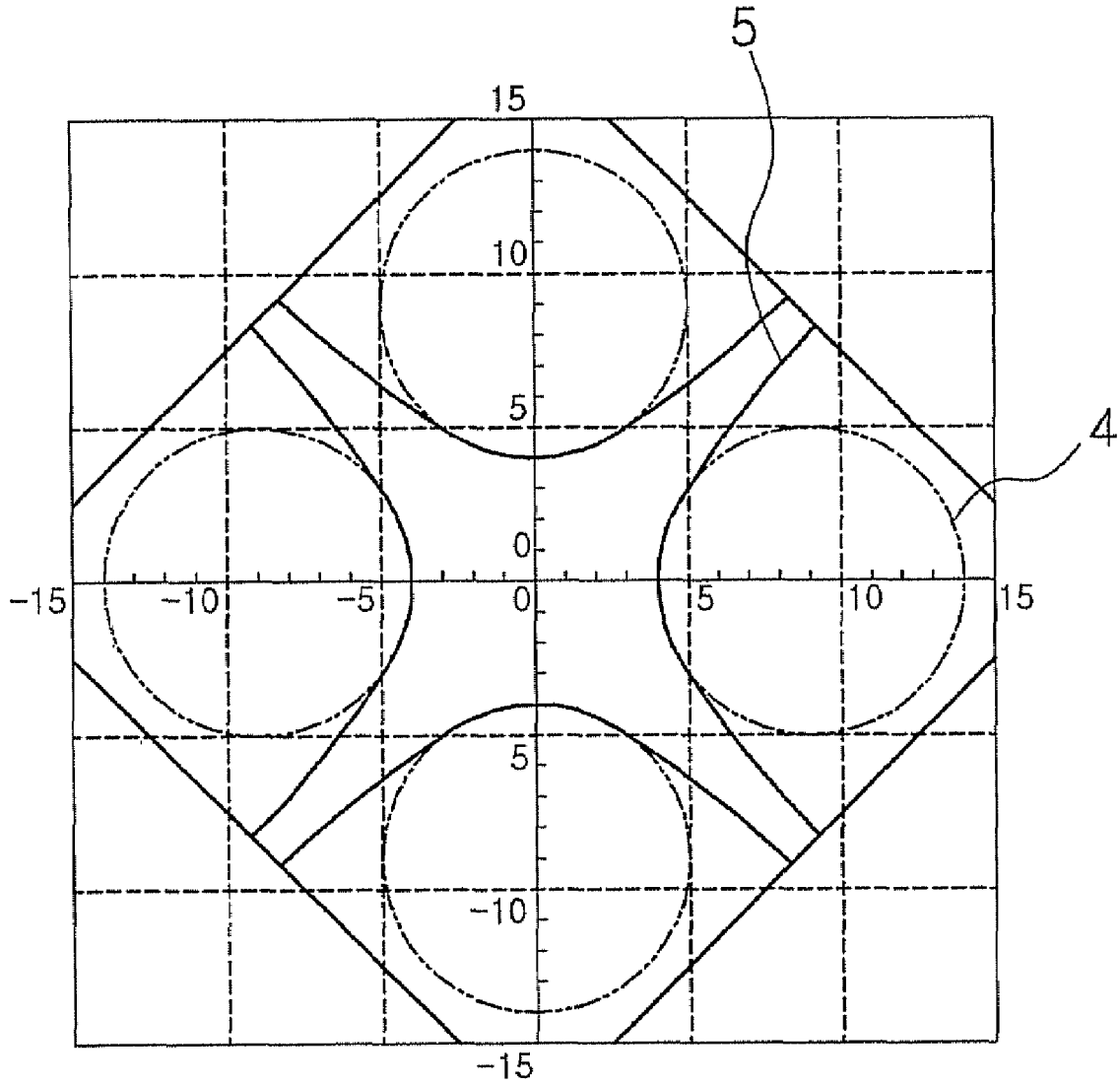

【Fig. 3】
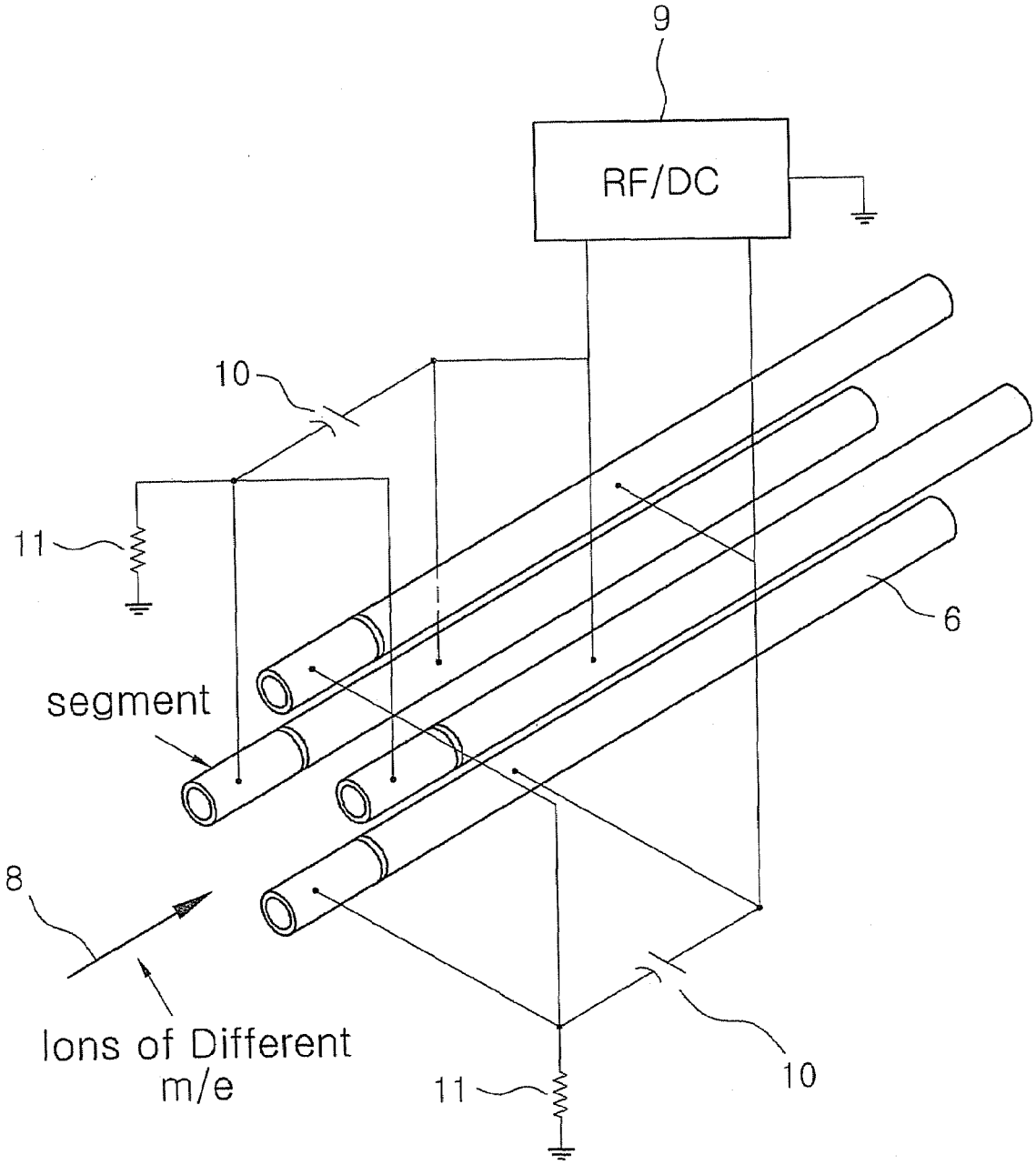

【Fig. 4】
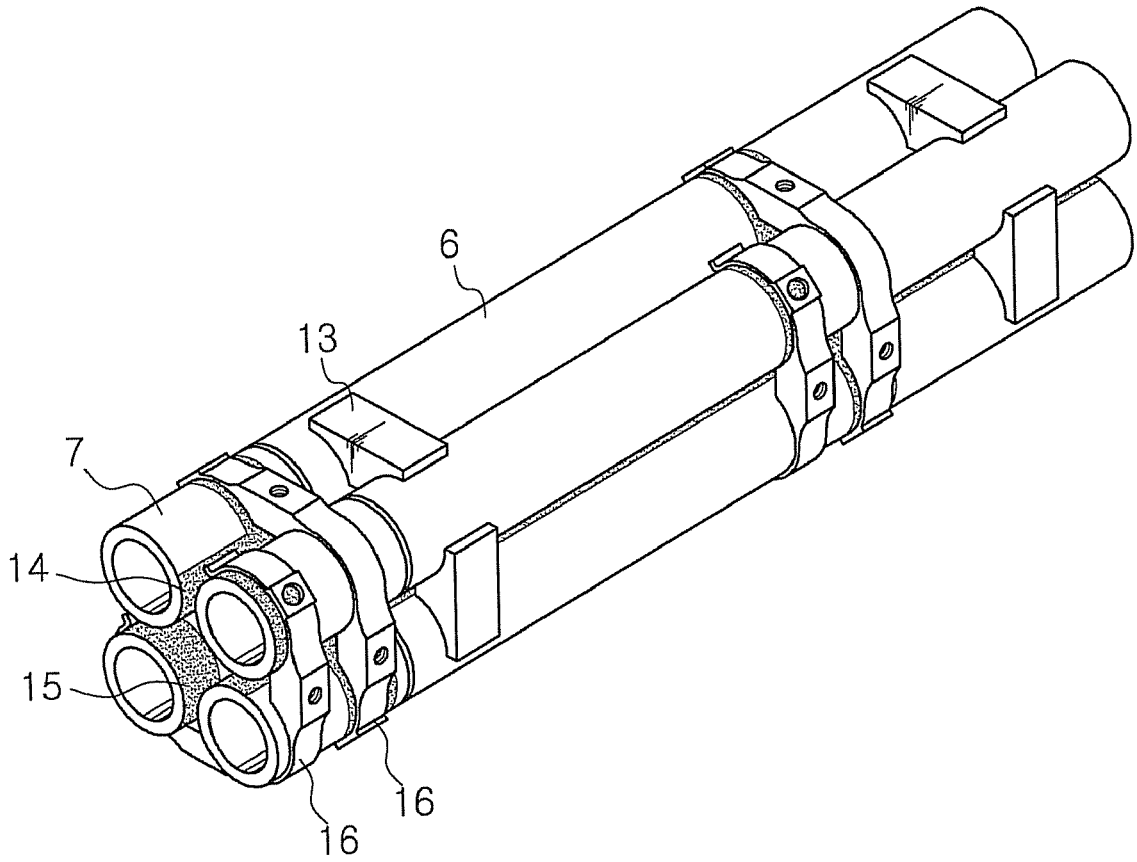

【Fig. 5】
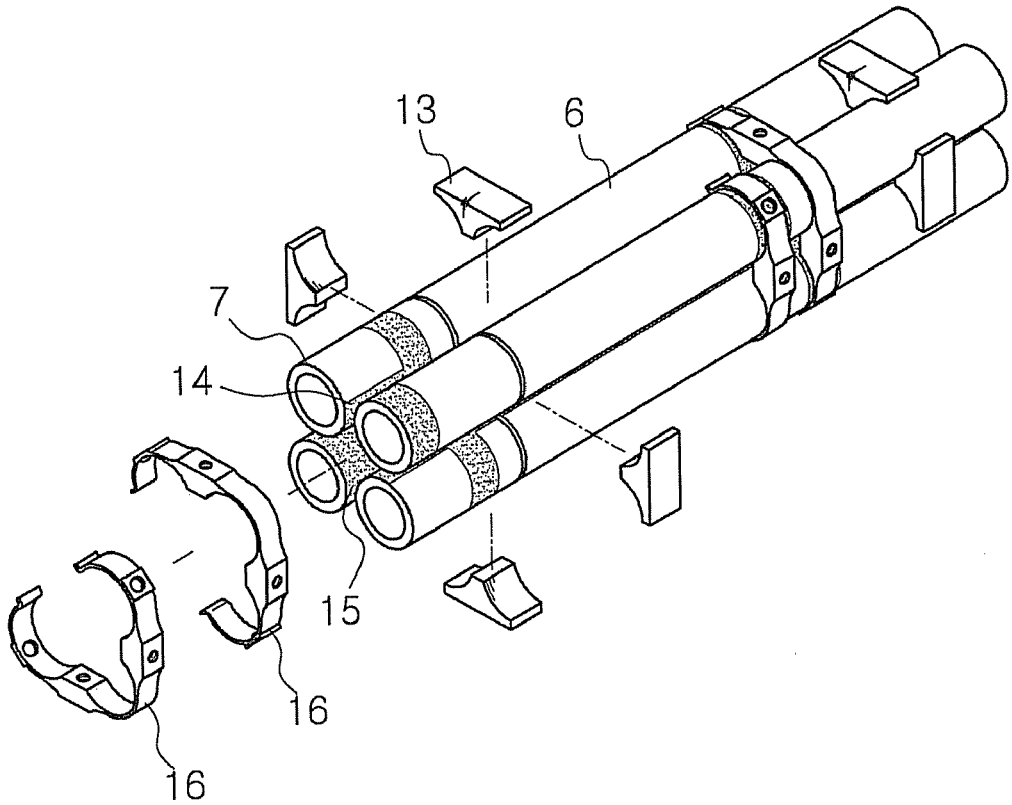
【Fig. 6】
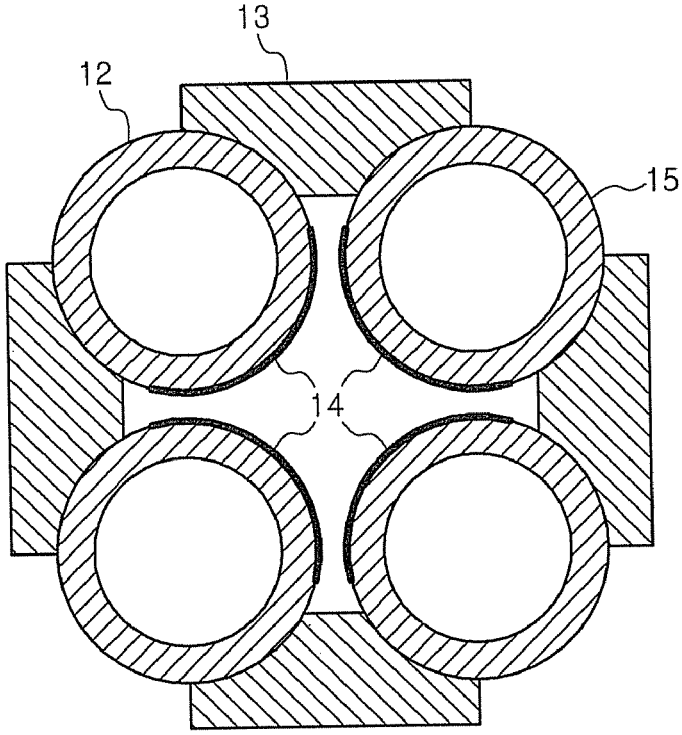

【Fig. 7】
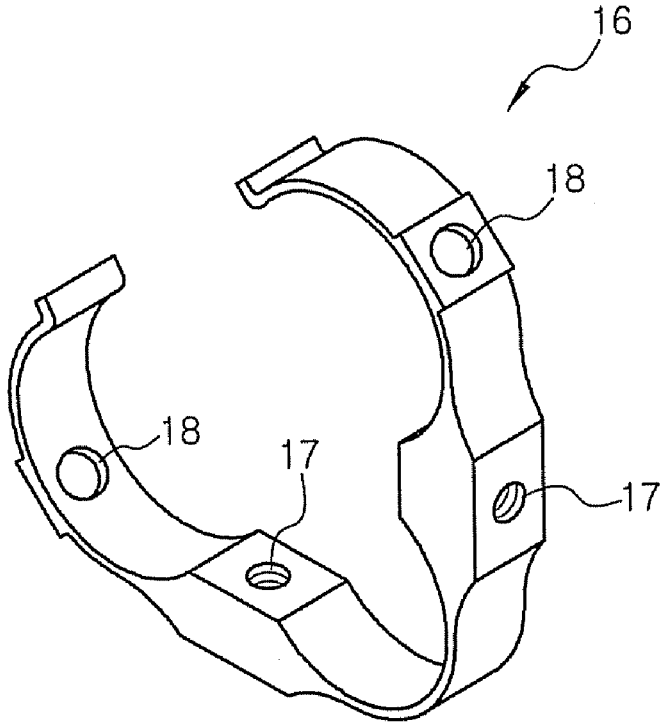
【Fig. 8】
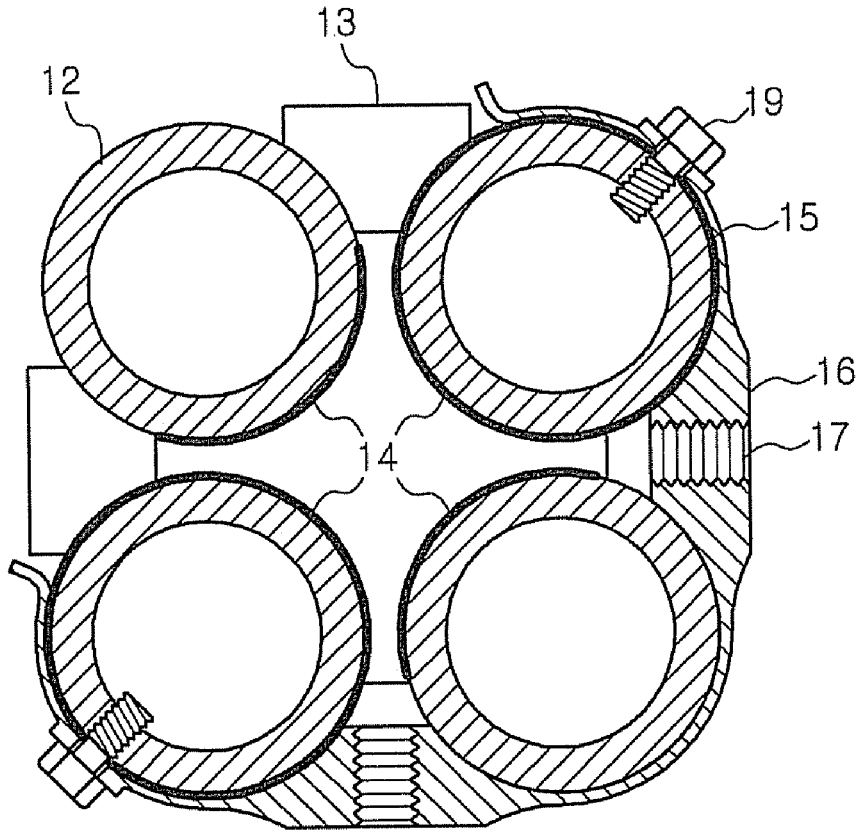

HYPERBOLIC QUADRUPOLE MASS FILTER MADE OF PLATINUM GROUP METAL COATED QUARTZ TUBE

TECHNICAL FIELD

The present invention relates to a quadrupole mass analyzer which is a core equipment in the majority of mass analyzers, particularly to a quadrupole mass analyzer with a hyperbolic surface made of quartz tubes which is capable of enhancing resolving power and analytical performance of a mass analyzer.

BACKGROUND ART

A quadrupole mass analyzer is an equipment which is constructed with four electrodes and separates mass of ions passing therethrough by applying electric field to two pairs of electrodes, each pair constructed by connecting two opposing electrodes, and it is the most ideal in the case that a central space thereof has a hyperbolic surface.

FIG. 1 shows an ideal quadrupole mass analyzer with hyperbolic surface.

As shown in FIG. 1, it is ideal for a quadrupole to be manufactured of four parallel metal rods 3 with hyperbolic surface expressed by an equation of $X^2-Y^2$=constant. Two pairs of the rods 1 and 2 are made by connecting two opposing rods, and U+V cos(2πft) is applied to one pair thereof and −U−V cos(2πft) is applied to the other pair thereof (herein, U indicates DC voltage, V indicates a peak value of radio frequency (RF) voltage, and f indicates frequency of the RF voltage). When a specific ion is entered into the quadrupole, it moves with oscillation in a direction perpendicular to a proceeding axis. This movement is determined by two differential equations which are called as Mathieu equation. Though an ion with selected mass passes through the quadrupole with a stable movement, ions with different mass are eliminated by collision into the rods as the movement thereof is unstable in which an amplitude of the oscillation is getting bigger.

A circular rod 4, as shown in FIG. 2, can substitute only some central part of the hyperbolic surface, and the more it become distant from the center the more it is different from the ideal hyperbolic electric field. Therefore, split of mass spectrum peak and decrement of resolving power are occurred by nonlinear motion of ions passing through the quadrupole.

FIG. 3 shows a conventional quadrupole mass analyzer constructed with circular rods and an electric connection of each rod. The conventional quadrupole mass analyzer is constructed with a main filter electrode part 6, the length thereof being more than 100 mm, and a prefilter electrode part 7, the length thereof being about 20 mm. Separation between the main filter electrode part 6 and the prefilter electrode part 7 of the quadrupole mass analyzer is about 2 mm. An RF/DC electric source 9 is connected to the quadrupole main filter electrode part 6, to one pair thereof is applied U+V cos(2πft) and to the other pair is applied −U−V cos(2πft) which is opposite phase of the prior. Same positions of the main filter electrode part 6 and the prefilter electrode part 7 of the each pair are connected with a capacitor and RF voltage V cos (2πft), in which the DC voltage U is blocked, is applied thereto. To the quadrupole prefilter electrode part 7 is applied proper DC voltage through about 10MΩ of resistor 11, whereby an ion beam 8 is easily entered into the quadrupole.

The quadrupole prefilter electrode part 7 removes in advance small ions of which mass is less than 30% of the mass of ions passing through the main filter electrode part 6 when the ion beam 9 passes through the inside of the quadrupole prefilter electrode part 7 where only RF voltage is applied.

In a mass spectrometer which analyzes organic samples such as a Gas chromatograph-mass spectrometer (GCMS), in order to prevent the organic materials from adhering to an ion source and a quadrupole mass analyzer, they are heated by a cartridge heater to maintain temperature about 200 to 250° C. Further, in a Residual Gas Analyzer (RGA) used in analysis of vacuum residual gas components, a whole vacuum chamber is heated to about 200° C. so as to drop a background peak. In such cases, a conventional quadrupole mass analyzer made of metal rods is subjected to extreme expansion and contraction by heat, whereby it gradually loses an original assembling accuracy with oxidation of the metal surface, and at the same time its performance is gradually dropped. As such, a conventional quadrupole mass analyzer made of circular metal rods has a difficulty in that a prefilter has to be made separately to a quadrupole main filter and be attached accurately in the same axis of the main filter in parallel to the main filter as well as disadvantages of split of peak and decrement of resolving power by nonlinear motion of ions and gradual drop of a performance.

A first attempt for resolving the difficulty of assembling the four circular rods with accuracy and a problem of gradual torsion by expansion and contraction of metal is disclosed in U.S. Pat. No. 3,328,146 in 1967, in this invention a mandrel with four cylindrical concave is made of Cr—Ni steel or stainless steel and is fitted with a glass tube, and then the glass tube is pumped by vacuum pump while being heated to the temperature in which a glass is deformable. Then, the glass is contracted and adhered to a surface of the mandrel, an integral quadrupole shape is formed within the glass tube by removing the mandrel after the temperature of the mandrel being dropped to a room temperature, the four cylindrical surface inside of the glass is gold-plated and then used as a quadrupole. As a glass tube to be used in this method, a special glass having coefficient of thermal expansion similar to that of steel used as a mandrel has to be used. If the coefficient of thermal expansion is different in a little, the glass is broken in pieces while the temperature is dropped. An integral quadrupole with light weight can be manufactured by such method, however commercial sales thereof was not realized relative to the quadrupole made of four metal rods due to high coefficient of thermal expansion of glass which is similar to steel, low level of gold-plating ability at that time and difficulty of manufacturing.

In 1988, a method for manufacturing an integral quartz quadrupole mass analyzer using a quartz tube instead of a glass tube and a molybdenum mandrel with hyperbolic surface by the same method as the above mentioned method is disclosed by Hewlett-Packard Co. (U.S. Pat. No. 4,885,500). In this method, because it is difficult to gold-plate accurately four hyperbolic surface which are located inside of an integral quartz with narrow space and are about 200 mm in length, a mandrel has four stainless steel plates and four hyperbolic surface electrodes are constructed by the steel plates being pressed to be attached to an inside of the quartz tube when the quartz tube is attached to the mandrel. However, as coefficient of thermal expansion of a quartz tube is different from that of a stainless steel plate, the quartz tube is easily broken and oxidation of the molybdenum mandrel and the stainless steel plates is great when the quartz tube is heated to 1550° C. at which temperature the quartz tube is deformable to have hyperbolic surface and then the temperature thereof drops to a room temperature, there is also a problem that electric charges get accumulated in a concave between the stainless steel plate electrodes thereby deforming hyperbolic electric fields of the electrode portion. Therefore, it is very difficult to manufacture actually a quadrupole by this method.

DISCLOSURE OF THE INVENTION

It is an object of the present invention to provide a quadrupole mass analyzer wherein a hyperbolic surface coated with platinum group metal is formed on each surface of four quartz tubes having low coefficient of thermal expansion and thus gradual drop of performance by expansion and contraction of the quadrupole is small, and it is another object of the present invention to provide a quadrupole mass analyzer with a hyperbolic surface wherein a platinum membrane of accurate shape is formed on the hyperbolic surface of each quartz tube so as to have fine and solid structure relative to a gold-plated surface, thereby being not easily damaged. It is yet another object of the present invention to provide a quadrupole mass analyzer wherein a main filter electrode and a prefilter electrode are formed on one quartz tube thereby capable of mounting prefilter in place without accurate assembly, and finally it has good durability as well as high resolving power and high performance.

To achieve the above objects, the present invention provides a quadrupole mass analyzer which includes four quartz tubes separated by predetermined distance to form a shape of rotation symmetry and being parallel to each other; an electric part formed with a predetermined area by a platinum coating being divided into a prefilter electrode part and a main filter electrode part in a longitudinal direction of the quartz tube in a circumferential surface in an axial direction of the rotation symmetry of the quartz tube, a cross-section of the gold or platinum coating on an opposing quartz tube forming a substantial hyperbolic surface; a quartz pin being chamfered at both ends in a shape with a same radius curvature as the quartz tube and being closely fixed between the adjacent quartz tubes; and an electrically conductive connection member electrically connecting each of prefilter electrode parts and main filter parts of the opposing quartz tubes so as to apply RF and DC electric source.

The quartz pins are used to fix the adjacent quartz tubes with a ceramic bond, and the four quartz tubes have a same diameter.

In order that each of the prefilter electrode parts and the main filter electrode parts of the opposing quartz tube are electrically connected and RF and DC electric source is applied thereto, a conductive band is provided on each of the prefilter electrode parts and the main filter electrode parts of the quartz tubes so that they are in same positions relative to opposing quartz tubes and are separated to be in different positions relative to not opposing quartz tubes, whereby the opposing quartz tubes are electrically connected through the conductive band.

The conductive connection member is made of copper and may have a shape of closed curve or open curve, preferably it has 'C' shape to enclosure three quartz tube, in particular three arcs are preferably formed with same radius curvature as that of the quartz tube at an inside surface of the conductive connection member so that the three quartz tubes are in close contact with the conductive connection member at the same time.

Two taps for connecting to an outer electric source is provided at the conductive connection member, and the conductive connection member and the quartz tube are provided with coupling holes at a position where they are in contact with each other thereby being fixed by a coupling member.

BRIEF DESCRIPTION OF THE DRAWINGS

FIG. 1 shows a quadrupole mass analyzer with an ideal hyperbolic surface;

FIG. 2 is a schematic diagram showing that a circular section can substitute only some part in center of the hyperbolic surface by comparison of an ideal hyperbolic surface with a circular section;

FIG. 3 shows a conventional quadrupole mass analyzer assembled with circular metal rods;

FIG. 4 is an assembled perspective view of a quartz tube with a hyperbolic surface of a quadrupole mass analyzer according to the present invention;

FIG. 5 is an exploded perspective view of the hyperbolic surface quartz tube of the quadrupole mass analyzer according to the present invention;

FIG. 6 is a cross-sectional view taken along line A-A in FIG. 4;

FIG. 7 is a perspective view of a connection member connecting electrode parts of the quartz tube; and FIG. 8 is a cross-sectional view taken along line B-B in FIG. 4.

DETAILED DESCRIPTION OF MAIN ELEMENTS

1, 2: an electrical connection of opposing electrodes of quadrupole with a hyperbolic surface
3: a rod forming a hyperbolic surface
4: a section of a circular rod
5: a section of a hyperbolic surface
6: a quadrupole main filter electrode part with a circular rod
7: a quadrupole prefilter electrode part with a circular rod
8: an ion beam
9: a RF/DC quadrupole electric source
10: a capacitor which removes DC voltage
11: a resister for applying DC voltage to a prefilter
12: a quartz tube
13: a quartz pin
14: a platinum coating
15: a conductive band
16: a conductive connection member
17: a tap for connecting RF+DC electric source
18: a coupling hole
19: fastening bolt/nut

BEST MODE FOR CARRYING OUT THE INVENTION

Practical and presently preferred embodiments of the present invention are illustrative as shown in the following Examples and Comparative Examples.

However, it will be appreciated that those skilled in the art, on consideration of this disclosure, may make modifications and improvements within the spirit and scope of the present invention.

FIG. 4 is an assembled perspective view of a quartz tube with a hyperbolic surface of a quadrupole mass analyzer according to the present invention; FIG. 5 is an exploded perspective view of the quartz tube with the hyperbolic surface of the quadrupole mass analyzer according to the present invention; FIG. 6 is a sectional view taken along line A-A in FIG. 4 showing hyperbolic section in central portion of the quartz tube quadrupole mass analyzer and a coupling structure of quartz pins used in assembly of the four quartz tubes; FIG. 7 is a perspective view of a connection member connecting electrode parts of the quartz tube; and FIG. 8 is a sectional view taken along line B-B in FIG. 4 showing coupling of the connection member and the quartz tube.

Referring to FIG. 4 to FIG. 6, in a quadrupole mass analyzer with a hyperbolic surface made of quartz according to the present invention, four circular quartz tubes 12 are accurately worked, which are separated by a predetermined distance and form a shape of rotation symmetry and are parallel to each other, and have low coefficient of thermal expansion by $5\times10^{-7}$ cm/cm° C. and the same diameter; and then platinum is plated with a predetermined area on a circumferential surface in axial direction of rotation symmetry of the quartz tubes 12 to form a prefilter electrode part 7 and a main filter electrode part 6 in longitudinal direction of the quartz tubes 12, each being divided and electrically insulated by a non-plated part of about 2 mm width existing therebetween, whereby an electrode part is formed so that a cross section of a platinum coating 14 of the opposing quartz tubes 12 is substantial hyperbolic surface. At this time, the width of the platinum-plating is desirable to be about ⅓ of circumference of the quartz tube 12.

The four platinum-plated quartz tubes 12 are located in place relative to a molybdenum mandrel and then quartz pin 13 of about 10 mm width and a shape of 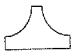 is provided by being chamfered at both ends so as to have a same radius curvature as the quartz tube 12 and being worked to be in close contact with the quartz tube 12, and total 8 of the quartz pins 13, in which four quartz pins 13 are provided at each of the four directions, are closely fixed between adjacent quartz tubes 12 by a ceramic bond durable at high temperature more than 500° C., whereby the four quartz tubes 12 are fixed apart from each other.

Meanwhile, four conductive connection members 16 of band shape are provided to electrically connect each of the prefilter electrode parts 7 and main electrode parts 6 of the opposing quartz tubes 12 and thus to apply RF and DC electric source, and the conductive connection members 16 are desirably made of copper, and have a 'C' shape as shown in FIG. 7, and three arcs are formed with a same radius curvature as that of the quartz tube 12 at an inside surface of the conductive connection member 16 so as to be in close contact with three quartz tubes 12 at the same time.

In the band shaped conductive connection member 16, in order to electrically connect each of the prefilter electrode parts 7 and main electrode parts 6 of the opposing quartz tubes 12 and thus to apply RF and DC electric source, as shown in FIG. 8, a platinum-plated conductive bands 15 of 8 mm width are formed at a predetermined position of each of the prefilter electrode parts 7 and the main electrode parts 6 of the opposing pair of quartz tubes 12, the conductive connection member 16 is provided on the conductive band 15 and thus an electric voltage is applied to only two specific electrode parts of opposing quartz tubes 12 by one conductive connection member 16.

An M3 tap for connecting to an outer electric source is provided at the conductive connection member 16 for connection to the outer electric source.

Coupling holes 18 of 3 mm diameter are provided at an opposite side of a hyperbolic surface where the quartz tube 12 with hyperbolic surface and the conductive connection member 16 are in contact with each other, so that the quartz tube 12 with hyperbolic surface and the conductive connection member 16 are communicated with each other, and a fastening bolt and a nut 19 are fixed through the coupling holes 18 so that RF+DC voltage is smoothly applied onto the conductive band 15 through conductive connection member 16. At this time, a M2 or M2.5 nut is inserted into a space of the quartz tube and then fixed with a M2 or M2.5 bolt.

INDUSTRIAL APPLICABILITY

As disclosed above, the quadrupole mass analyzer with a hyperbolic surface made of quartz according to the present invention has an advantage that there is no deformation due to thermal expansion or drop of performance even though it is heated to a temperature of 200° C. during mass analyzing as it uses platinum-plated quartz tubes instead of metal rods and the quartz tubes are coupled to each other by quartz pins and ceramic bond. Further, as a platinum surface is not oxidized, there is no surface change even though mineral acid and organic matter are analyzed for a long time, thereby original performance being maintained. Further, as hyperbolic surface is used instead of circular rod, nonlinear incompletion of the quadrupole electric field is decreased thereby obtaining a clear peak with no split thereof and enhancing the resolving power.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

The invention claimed is:

1. A quadrupole mass analyzer comprising four quartz tubes separated by predetermined distance to form a shape of rotation symmetry and being parallel to each other;

an electric part formed with a predetermined area by a platinum coating being divided into a prefilter electrode part and a main filter electrode part in a longitudinal direction of the quartz tube in a circumferential surface in an axial direction of the rotation symmetry of the quartz tube, a cross-section of the platinum group metal coating on an opposing quartz tube forming a substantial hyperbolic surface;

a quartz pin being chamfered at both ends in a shape with a same radius curvature as the quartz tube and being closely fixed between the adjacent quartz tubes; and an electrically conductive connection member electrically connecting each of prefilter electrode parts and main filter parts of the opposing quartz tubes so as to apply RF and DC electric source.

2. The quadrupole mass analyzer as set forth in claim 1, wherein the quartz pin and the adjacent quartz tube are fixed by ceramic bond.

3. The quadrupole mass analyzer as set forth in claim 2, wherein electrically conductive band is formed on same positions of the opposing quartz tubes, and the conductive connection member is provided on the conductive band.

4. The quadrupole mass analyzer as set forth in claim 3, wherein the conductive connection member is a 'C' shaped, and three arcs are formed with same radius curvature as that of the quartz tube at an inside surface of the conductive connection member so that the three quartz tubes are in close contact with the conductive connection member at the same time.

5. The quadrupole mass analyzer as set forth in claim 4, wherein a tap for connecting to an outer electric source is provided at the conductive connection member.

6. The quadrupole mass analyzer as set forth in claim 4, wherein the conductive connection member and the quartz tube are provided with coupling holes at a position where they are in contact with each other thereby being fixed by a coupling member.

* * * * *